United States Patent [19]

Sugimori

[11] Patent Number: 4,870,473

[45] Date of Patent: Sep. 26, 1989

[54] X-RAY IMAGE INTENSIFIER HAVING A SUPPORT RING THAT PREVENTS IMPLOSION

[75] Inventor: Fumio Sugimori, Yokohama, Japan

[73] Assignee: Kabushiki Kaisha Toshiba, Kawasaki, Japan

[21] Appl. No.: 325,039

[22] Filed: Mar. 16, 1989

Related U.S. Application Data

[63] Continuation of Ser. No. 101,662, Sep. 28, 1987, abandoned.

[30] Foreign Application Priority Data

Sep. 29, 1986 [JP] Japan ..... 61-230622

[51] Int. Cl.[4] ..... H01J 31/50; H01J 40/14

[52] U.S. Cl. ..... 250/213 VT; 313/524; 313/544

[58] Field of Search ..... 250/213 VT; 313/523, 313/524, 525, 541, 542, 543, 544

[56] References Cited

U.S. PATENT DOCUMENTS

| | | | |
|---|---|---|---|
| 3,515,924 | 6/1970 | Moegenbier | 313/544 |
| 4,331,898 | 5/1982 | Shimizu et al. | 250/213 VT |
| 4,422,008 | 12/1983 | Aramaki et al. | 313/524 |
| 4,423,351 | 12/1983 | Sugimori et al. | 313/541 |
| 4,611,144 | 9/1986 | Minami | 250/213 VT |

*Primary Examiner*—David C. Nelms
*Assistant Examiner*—William Oen
*Attorney, Agent, or Firm*—Cushman, Darby & Cushman

[57] ABSTRACT

This invention relates to an X-ray image intensifier for intensifying and reproducing an image of an object, by use of X-ray and the like. An evacuated envelope of the image intensifier is constituted by a cylindrical glass body having an open end and a closed end, an X-ray input window covering the open end of the body, and a support ring for providing a hermetical seal between the body and the window at the open end. The window is constituted by a domed portion which expands outwardly from the evacuated envelope, a flange portion which is formed around the peripheral edge of the window and has a flat bonding surface which extends perpendicular to the axis of the evacuated envelope, with a curved portion forming a transitional area between the domed and flange portions. The support ring is bonded to the flange portion, at the flat bonding surface, and has a smaller inner diameter than the outer diameter of the curved portion. Further, the inner end of the ring member is located inward of the inner end of the flange portion.

19 Claims, 3 Drawing Sheets

X-RAY IMAGE INTENSIFIER HAVING A SUPPORT RING THAT PREVENTS IMPLOSION

This is a continuation of application Ser. No. 101,662, filed Sept. 28, 1987, now abandoned.

BACKGROUND OF THE INVENTION

The present invention relates to an X-ray image intensifier for intensifying and reproducing an image of an object, by use of radiation such as X-rays, gamma rays, and the like and, more particularly, to an X-ray image intensifier having an improved evacuated envelope.

In the field of medicine, X-ray image intensifiers are widely used for medical diagnosis, and in the industrial field, on the other hand, they are used in nondestructive testing.

In general, an X-ray image intensifier comprises an input screen, an output screen, a focusing electrode, an anode, and the like, and an evacuated envelope within which these components, arranged at appropriate positions therewithin, are sealed. More specifically, the input screen is arranged at the X-ray input side, and the output screen and the anode are arranged at the X-ray output side. The two screens face each other. The input screen is shaped as a focusing lens constituting an aspheric surface so as to form a focal plane on the output screen. The focusing electrode is arranged along the inner wall of the evacuated envelope, and guides photo electrons radiated from the input screen toward the output screen, while simultaneously accelerating and focusing them.

The evacuated envelope comprises a cylindrical body having one open and closed end, with a dome-like X-ray input window covering the open end of the body. The cylindrical body is formed of a glass or ceramic insulating material, in order to prevent discharging of an acceleration electrode and also to output a visible optical image or an image intensifying signal such as an electrical signal converted inside the evacuated envelope. The X-ray input window is fitted on the input side of the evacuated envelope, and is in the form of a metal plate made of either Al (aluminum) or Al alloy in order to lower an amount of scattered incident X-rays and to maintain a mechanical strength of the window at a predetermined level or higher. The X-ray incident side of the window is shaped as an aspheric surface, in the same manner as the input screen, so as to uniformly radiate X-rays onto the input screen in the evacuated envelope.

When the image intensifier having the above structure is in operation, a predetermined potential difference is provided across the focusing electrode and the anode. X-rays radiated from an X-ray source are transmitted through the subject being examined and the input window, and thereafter are incident on the input screen. The incident X-rays are converted to visible light by a phosphor layer formed by coating a phosphor material, e.g., CsI on the input screen, and the visible light is converted to photo-electrons by a photoemissive layer formed thereon. The photo-electrons are accelerated and focused by the focusing electrode and the anode constituting an electron lens, and are again converted to visible light by the output screen arranged behind the anode. As a result, a visible image is formed on the output screen.

The image can be directly observed through the output window, or through a television set, or can be visualized as a photograph. Using the image, medical diagnosis can be performed.

At the X-ray input side of the image intensifier, X-rays are not radiated directly onto the input screen having X-ray-visible light conversion and photoelectric conversion functions, but are instead radiated indirectly thereonto, through the input window.

The interior of the evacuated envelope must be kept at a high vacuum level, of $10^{-7}$ to $10^{-8}$ Torr, in order to stably pass photo-electrons from the input screen toward the output screen. If the window is omitted and the input screen is directly used to act as a window to maintain the high vacuum, the input screen is deformed or cracked by the outside atmospheric pressure directly applied thereonto. As a result, predetermined photoelectrons cannot be emitted from the input screen in a predetermined manner.

Since the interior of the evacuated envelope is maintained at a high vacuum, if the structure and material of the input window are inappropriately selected, the input window may be broken by the outside atmospheric pressure, i.e., a so-called implosion may occur. The implosion may be suppressed by increasing the thickness of the input window to strengthen the window.

However, increasing the thickness of the input window will result in a decrease in the SN ratio (signal-to-noise ratio) of incident X-rays as well as an undesirable increase in the total weight of the overall image intensifier. For this reason, Al or an Al alloy is used as the material of the input window, since it has a high strength-to-weight ratio and good X-ray transmissivity, and minimizes X-ray scattering.

However, it is not easy to achieve a hermetic bond between an Al material and a ceramic material or glass. This obstructs a manufacture of a large image intensifier.

A technique has been proposed wherein an intermediate member (support ring) that can be stably and hermetic bonded to a glass or ceramic material is provided between a glass body and an aluminum window, and these members are bonded through the intermediate member.

West German Patent No. 2331210 is known as a technique for hermetic bonding an envelope body and an input window through a support ring. In this known technique, a peripheral portion of an aluminum window is bent to extend along the inner wall of a cylindrical body, a copper support ring is interposed between the body and the window, and the window is bonded to the body through the support ring to be fitted therein.

However, in this known technique, since the end portion of the support ring is extended by bonding and projects from the evacuated envelope, the projecting portion must be removed after bonding, resulting in complex machining and high manufacturing cost.

As another technique for hermetic bonding of a body and an input window through a support ring, U.S. Pat. No. 4,423,351 is known.

According to FIG. 4 in U.S. Pat. No. 4,423,351, input window 24, intermediate metal ring 42 and washer ring 50 are coaxially provided. Peripheral portion 41 of window 24 is overlaid to be clamped between a joint of ring 42 and washer ring 50, and the overlapping portion of these three components is subjected to hot press welding by ring tip portions 48*a* and 49*a* of press welding apparatuses. The welded portion is flat, and extends to be perpendicular to the axis of a vacuum container (evacuated envelope). In order to ensure the mechanical strength of the support portion, the thickness of intermediate metal ring 42 is larger than that of input window 24. Peripheral portion 41 and the joint portion of intermediate metal ring 42 extend in a direction perpendicular to the axis of the vacuum container, and finally, the inner end of peripheral portion 41 is at the same position a that of the joint portion of intermediate metal ring 42, as shown in the drawing. More specifically, the inner diameters of intermediate metal ring 42 and peripheral portion 41 are designed to coincide with each other. In order to improve a bonding property between intermediate metal ring 42 and a glass body (not shown), an Fe or Fe based alloy (to be referred to simply as an Fe material hereinafter) such as an Fe—Ni—Co alloy called Kovar (trade name) is employed as a material of intermediate metal ring 42. Note that in order to improve a bonding property between intermediate metal ring 42 and aluminum window 24, thin Ni plated layer 45 is formed on the surface of ring 42.

However, in the conventional image intensifier, if its interior is evacuated, a curved portion formed on a transitional area from the domed portion of input window 24 to the peripheral portion 41 is acted upon an atmospheric pressure and is recessed inwardly, and finally, input window 24 may be imploded.

SUMMARY OF THE INVENTION

It is an object of the present invention to provide an image intensifier which can prevent implosion without increasing a thickness of an input window.

According to an aspect of the present invention, in an X-ray image intensifier having an evacuated envelope, an input screen, housed in the evacuated envelope, for converting incident X-rays into photo-electrons, and an output screen, housed in the evacuated envelope, for converting the photo-electrons from the input screen into visible light and forming an image, the evacuated envelope has a cylindrical body having an open end and a closed end, a window covering the open end, and a ring member for providing a hermetic seal between the body and window at the open end of the body. The window is constituted by a domed portion expanding outwardly from the evacuated envelope, a flange portion formed around the peripheral edge of the window and having a flat bonding surface extending perpendicular to its axis, and a curved portion which forms transitional area extending from the domed portion to the flange portion. The ring member is bonded to the flange portion at the flat bonding surface. That is, an inner end of the ring member is located inward of an inner end of the flange portion. Further, inner diameter of the ring member is smaller than an outer diameter of the curved portion. In this case, the ring portion preferably has a smaller inner diameter than an inner diameter of the curved portion.

When the internal pressure of the evacuated envelope with the above structure is decreased by a vacuum pump, the domed and curved portions which are not directly supported by the ring member are acted upon the atmospheric pressure, and the curved portion with a small deformation resistance tends to be partially recessed. However, since the ring member is designed to have an inner diameter smaller than that of the curved portion, the ring member can reinforce the curved portion, so that free deformation of the curved portion is prevented by the ring member. For this reason, buckling of the curved portion can be prevented without increasing the thickness of the window, and implosion of the evacuated envelope can be prevented.

DETAILED DESCRIPTION OF THE PREFERRED EMBODIMENTS

Various embodiments of the present invention will now be described with reference to the accompanying drawings.

A case will now be described in detail wherein a 9 inches image intensifier is applied to an X-ray diagnosis apparatus.

Figure 1:
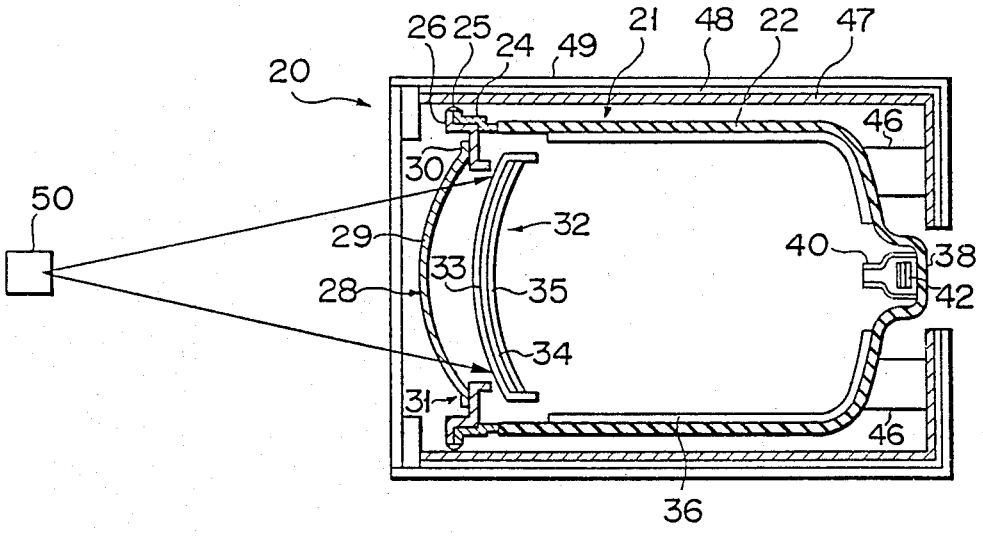
FIG. 1 is a longitudinal sectional view showing a diagnosis apparatus employing an X-ray image intensifier according to a first embodiment of the present invention.

As shown in FIG. 1, X-ray image intensifier 20 according to a first embodiment is housed in container 49 lined by lead plates 47 and magnetic shield 48 and is fixed to the rear surface of container 49 by support members 46. X-ray source 50 is arranged in front of container 49 to be separated therefrom, so that X-rays of a predetermined intensity are radiated onto the input side of image intensifier 20.

The exterior of image intensifier 20 is enclosed by evacuated envelope 21. Glass body 22 constituting a main part of evacuated envelope 21 has a cylindrical shape having closed and open ends. The central bottom portion of body 22 partially projects to form output window 38. Anode 40 and output screen 42 are arranged inside output window 38. Evacuated envelope 21 has a diameter and a length of about 275 mm. Focusing electrode 36 for accelerating and focusing photoelectrons is lined on the inner peripheral surface and a part of the inner bottom surface of glass body 22.

At the input side of evacuated envelope 21, input screen 32 is housed. Input screen 32 has a three-layered structure in which Al substrate 33, phosphor layer 34, and photoemissive layer 35 are sequentially stacked from the input side. Input screen 32 has an aspheric shape for focusing electrons onto output screen 42.

Figure 2:
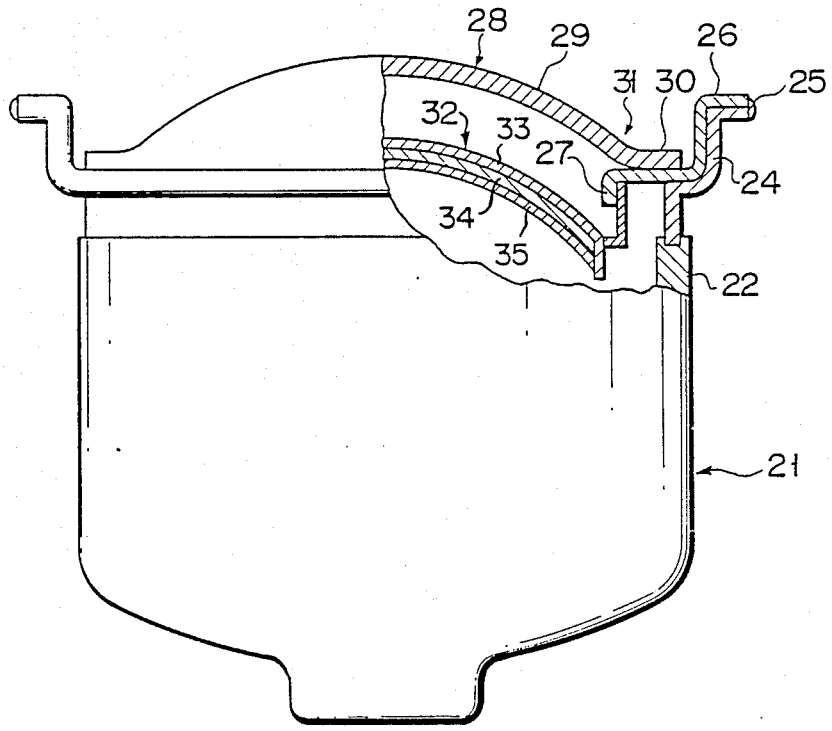
FIG. 2 is a partial cutaway longitudinal sectional view of the X-ray image intensifier according to the first embodiment.

As shown in FIG. 2, support ring 24 of Kovar is hermetic bonded to the open end of glass body 22. Support ring (intermediate member) 26 of Al or an Al alloy is overlaid on support ring 24, and is hermetic bonded thereto at welding portion 25. Support rings 24 and 26 are provided so that their outer peripheral end faces are on the same level. Welding portion 25 is formed by edge welding around the circumference of rings 24 and 26 by an inert gas arc welding method.

Window 28 closes the open end of glass body 22 intermediating ring 24 and support ring 26, thus sealing the interior of evacuated envelope 21. Window 28 is made of a single circular thin plate having a uniform thickness, and has domed portion 29 formed by expanding the main part of window 28 outwardly. Domed portion 29 has a aspheric surface substantially the same as that of input screen 32. Flange portion 30 is formed at the peripheral edge of domed portion 29. Flange portion 30 is flat, and extends in a direction perpendicular to the central axis of evacuated envelope 21.

Flange portion 30 is overlaid on the inner end portion 27 of support ring 26, and they are hermetic bonded to each other by hot pressure welding. When flange portion 30 is overlaid on support ring 26, inner end of ring 26 is located closer to the central axis side than is the inner end of curved portion 31 at which domed portion 29 is deformed to be flange portion 30. The width of flange portion 30 is about 5 to 6 mm. The thickness of window 28 is about 0.9 mm, and the thickness of support ring 26 is about 2 mm.

In this case, as the material of window 28, Al or an Al alloy is preferable, and most preferably, a reinforced Al alloy to which at least one of Si, Cu, Mn and Mg is added, is employed. Further, in this case, a total content of reinforcing elements is preferably about 0.5% or higher. The thickness of the window preferably falls within the range of 0.5 to 2.0 mm, and most preferably, 0.6 to 1.2 mm. Furthermore, a radius of curvature of the curved portion of the window is preferably 1 to 3 times the thickness of the window, and most preferably, twice the thickness of the window.

When the overlapping portions are bonded by hot pressure welding, a washer ring is preferably overlaid on flange portion 30 to prevent expulsion and surface flash of flange portion 30. As preferable hot pressure welding conditions, a pressure of about 1100 kg/cm$^2$ is applied at a heating temperature for the bonding portion of 470° C., and a pressure of about 250 kg/cm$^2$ is applied at a heating temperature for the bonding portion of 630° C.

Note that hermetic bonding between the window and the support ring is preferably performed by hot pressure welding the overlapping portions therebetween or edge welding their outer peripheral end faces. In particular, in a large-sized intensifier of 14 inches or larger, the support ring is formed of an Al material, so that the Al materials are edge welded by tungsten inert gas arc welding.

The mechanical strength of support ring 26 is preferably set to be higher than that of window 28. For example, a material having a higher mechanical strength than that of the Al material is preferably selected as the material of ring 26 or the thickness of window 28 is preferably increased. The material of support ring 26 is preferably Fe or an Fe alloy, or Al or an Al alloy. The Fe alloy used for support ring 26 is preferably an Fe—Ni—Co alloy (Kovar), an Fe—Ni—Cr alloy (stainless steel), or an Fe—Ni—Cu alloy (permalloy or a ferromagnetic material similar thereto) and more preferably, an Fe—Ni—Co alloy (Kovar). If support ring 26 is formed of Fe or an Fe alloy, Ni plating is performed on the surface, and support ring 26 is overlaid on window 28 of the Al material and is bonded thereto by hot pressure welding. The thickness of support ring 26 is preferably larger than that of window 28, and more preferably, is 2 mm or more.

Support ring 26 is preferably designed so that its inner diameter is larger than that of flange portion 30 by 1 mm or more, and most preferably, a difference between their inner diameters is 2 mm or more so as not to shield incident X-rays.

When input window 28 is hermetic bonded to body 22 through rings 24 and 26, evacuated envelope 21 is evacuated to a vacuum pressure of about $10^{-8}$ Torr.

Figure 3:
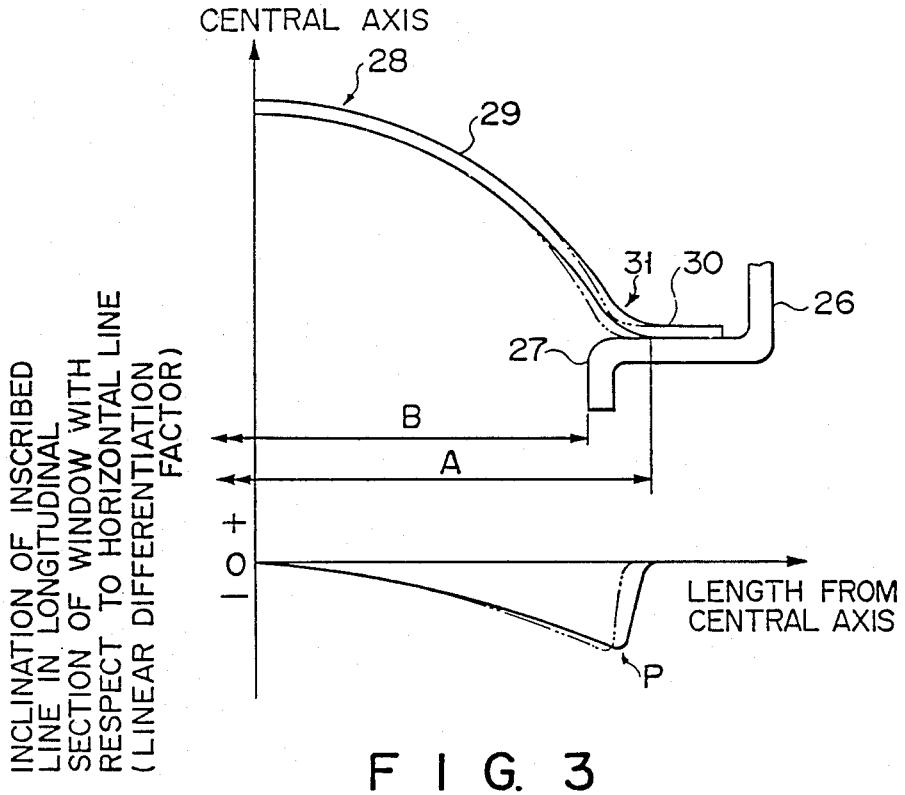
FIG. 3 is a longitudinal sectional view showing (upper drawing) when a window and a support ring are cut along a plane including a central axis of evacuated envelope and a graph showing (lower diagram) a change in inclination of an inscribed line in a longitudinal section of the window with respect to a horizontal line, wherein a length from the central axis of the evacuated envelope is plotted along the ordinate, and an inclination (linear differentiation factor) of an inscribed line in the longitudinal section of the window with respect to the horizontal line is plotted along the abscissa.

The upper drawing in FIG. 3 is a longitudinal sectional view when the window and the support ring are cut along a plane including the central axis. In FIG. 3, symbol A indicates the inner diameter of flange portion 30 and outer diameter of the curved portion 31, and symbol B indicates the inner diameter of support ring 26. Symbol C represents the inner diameter of the curved portion before deformation. In FIG. 3, a solid curve represents a shape of window 28 before evacuation, and an alternate long and two short dashed curve represents a shape after evacuation.

The lower diagram in FIG. 3 is a graph illustrating a change in shape of the window before and after evacuation, wherein a length from the central axis of the evacuated envelope is plotted along the ordinate, and an inclination (linear differentiation factor) of an inscribed line in the longitudinal section of the window with respect to the horizontal line is plotted along the abscissa. In this graph, a solid curve represents data before evacuation, and an alternate long and two short dashed curve represents data after evacuation.

As can be seen from the graph of FIG. 3, the linear differentiation factor is monotonously changed at domed portion 29. However, a so-called inflection point at which an inclination of the linear differentiation factor is inverted is present at curved portion 31. For this reason, curved portion 31 including a portion corresponding to inflection point "P" has the smallest deformation resistance against an external pressure in overall window 28. Therefore, if the interior of evacuated envelope 21 is evacuated, only curved portion 31 buckles and is partially recessed.

However, since inner end 27 of support ring 26 is located at the side of the central axis from the inner end (a portion corresponding to injection point "P") of curved portion 31, curved portion 31 abuts against support ring 26, and inward deformation is interrupted. Thus, a recess due to buckling does not expand, and hence, implosion of evacuated envelope 21 can be prevented.

Figure 4:
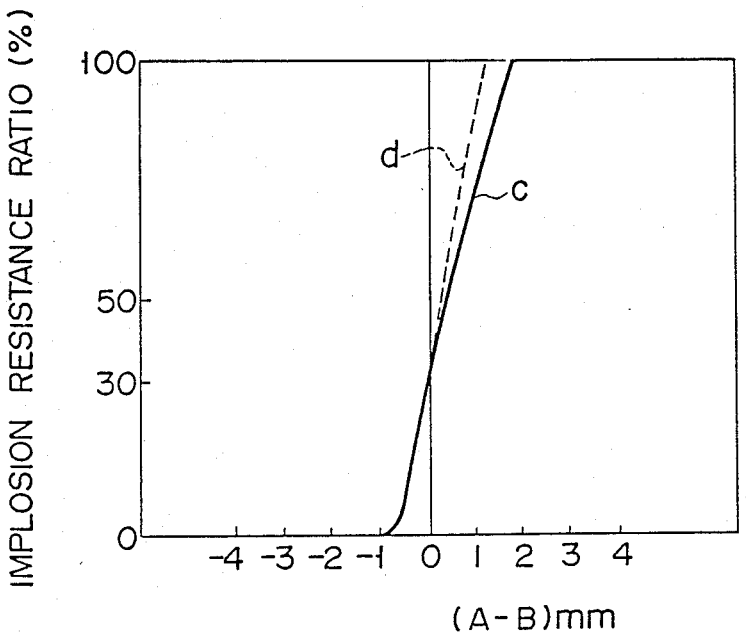
FIG. 4 is a graph showing effects of the first and second embodiments.

FIG. 4 is a graph showing an influence of an inner diameter difference (A−B) with respect to an implosion resistance ratio, in an experiment wherein the window had a thickness of 0.9 mm and various support rings were used. In FIG. 4, a difference between inner diameter A of the flange portion and inner diameter B of the support ring is plotted along the ordinate, and the implosion resistance ratio is plotted along the abscissa. In this graph, solid line c is a correlation line between the inner diameter difference (A−B) and the implosion resistance ratio when the support ring of the first embodiment was used, and broken line d is a correlation line when a support ring of a second embodiment (to be described later) was used.

As can be seen from solid line c in FIG. 4, the conventional image intensifier (inner diameter difference (A−B) is zero) has an implosion resistance ratio as low as about 30%. The image intensifier of support ring type according to the first embodiment can improve an implosion resistance ratio to 100% if the inner diameter difference (A−B) is set to be about 2 mm, and can substantially eliminate possibility of implosion. For this reason, the production yield of the image intensifier can be improved.

Since the thickness of the input window can be decreased to be smaller than that of the conventional structure, the SN ratio of the image intensifier can be improved, and hence, a more clear and distinct image can be displayed on the output screen. In addition, the total weight of the image intensifier can be reduced.

The same effects as above can be obtained if the shape of the support ring of the first embodiment is modified as shown in FIGS. 5 to 8.

Figure 5:
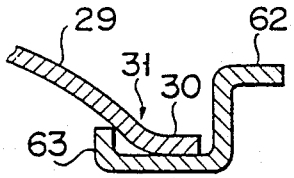
FIGS. 5 to 8 are longitudinal sectional views respectively showing a window and a bonding portion of a support ring in a modification of the first embodiment.
Figure 8:
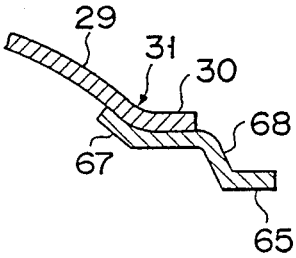

More specifically, when the inner end portion of the support ring is urged against or is in tight contact with domed portion 29 like inner end portion 63 in FIG. 5 and inner end portion 67 in FIG. 8, not only flange portion 30 but also domed portion 29 are reinforced by the support ring. Therefore, local deformation of window 28 can be more effectively prevented.

Figure 6:
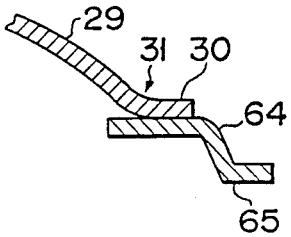
Figure 7:
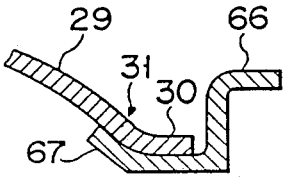
Figure 9:
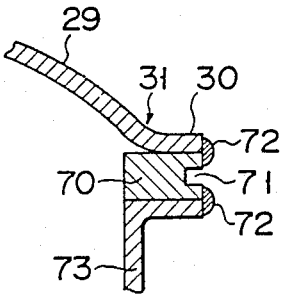
FIGS. 9 and 10 are longitudinal sectional views respectively showing a window and a bonding portion of a support ring in the second embodiment and its modification.

When the outer end portion is offset from the inner end portion like outer end portion 65 of the support ring shown in FIGS. 6 and 8, the elasticity of the support ring can be improved, and the support ring can partially receive stress of local deformation due to atmospheric pressure. Thus, the implosion of evacuated envelope can be more effectively prevented FIG. 9 shows a partial section of an evacuated envelope of an image intensifier according to a second embodiment of the present invention. The description of the common part of the second and first embodiments will be omitted. Support ring 70 has a substantially rectangular longitudinal section, and groove 71 is formed in its outer periphery. Support ring 70 is clamped between input window and another support ring 73 (one end of which is hermetically bonded to a glass body (not shown)). The outer diameters of input window, support ring 70, and another support ring 73 are substantially the same. The outer peripheral end faces of flange portion 30 and support ring 70 and those of support ring 70 and another support ring 73 which are on the same level are hermetically bonded to each other by welding portion 72. Welding portion 72 is formed by edge welding using an inert gas arc welding method (e.g., AC TIG welding). The thickness of support ring 70 is preferably set to be 2 mm or more, and most preferably, 3 to 10 mm.

Note that as a material for support ring 70 and another support ring 73, Al or an Al alloy is used. However, the present invention is not limited to this. For example, an Fe-based alloy such as Kovar or stainless steel may be employed.

According to the second embodiment, as indicated by broken line d in FIG. 4, when an inner diameter difference (A−B) of the flange portion and the support ring is set to be 1 mm or more, the implosion resistance ratio can be improved to about 100%. For this reason, the product yield of the image intensifier can be further improved, and the thickness of the input window can be decreased. Therefore, a clearer image than a conventional structure can be obtained.

Since the curved portion is reinforced by the support ring, the structure of the second embodiment is suitable for a large-sized image intensifier of 14 inches or larger.

Since the groove is formed on the outer periphery of the support ring, the welding workability for hermetical bonding can be improved, and welding stress can be eliminated.

Figure 10:
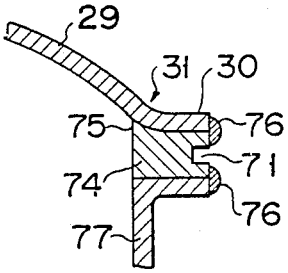

FIG. 10 shows a modification of the second embodiment. In this modification, inner end portion 75 of support ring 74 is brought into tight contact with curved portion 31 of window. With this structure, local deformation at the curved portion 31 of window can be more effectively prevented, and hence, the implosion of evacuated envelope can be prevented.

According to the present invention as described above, since the inner diameter of the support ring is set to be smaller than that of the flange portion, the curved portion having a small deformation resistance can be reinforced by the support ring, and local deformation at the curved portion can be prevented. Thus, even if a thin input window is adopted, implosion can be prevented. More specifically, in the conventional structure, the X-ray input window must have a large thickness in consideration of a possibility of implosion. If the input window having a large thickness is used, an X-ray transmissivity is decreased, and the SN ratio of the image intensifier is degraded. However, according to the present invention, the implosion of evacuated envelope can be effectively prevented, and the thickness of the input window can be reduced, thus greatly improving the SN ratio.

What is claimed is:

1. An X-ray image intensifier comprising:

an evacuated envelope including:

a cylindrical body having an open end and a closed end, an X-ray window covering said open end, said X-ray window including:

a domed portion expanding outwardly from said evacuated envelope;

a flange portion formed around a peripheral edge of said window and having a flat bonding surface extending perpendicular to the central axis of said evacuated envelope; and a curved portion that forms a transitional area extending from said domed portion to said flange portion, and a ring member providing a hermetic seal disposed between said body and said flange portion of said window at the open end of said cylindrical body, said ring member having an inner end that has a smaller inner diameter than an outer diameter of said curved portion of said window to help prevent implosion of said X-ray window during manufacture of said X-ray image intensifier;

an input screen housed in said evacuated envelope for converting incident X-rays into photo-electrons; and an output screen housed in said evacuated envelope for converting the photo-electrons from said input screen into visible light and forming an image.

2. An image intensifier according to claim 1, wherein said inner diameter of said ring member has a smaller inner diameter than an inner diameter of said curved portion of said window.

3. An image intensifier according to claim 1, wherein the mechanical strength of said ring member is higher than that of said flange portion of said window.

4. An image intensifier according to claim 1, wherein an inner diameter of said ring member is smaller than that of said curved portion of said window by not less than 2 mm.

5. An image intensifier according to claim 1, wherein a radius of curvature of said curved portion of said window is twice or more a thickness of said window.

6. An image intensifier according to claim 1, wherein said window is made of Al or an Al based alloy, and said ring member is selected from the group consisting of Fe, an Fe-based alloy, Al, and an Al-based alloy.

7. An image intensifier according to claim 6, wherein said ring member is made of an Fe—Ni—Co alloy.

8. An image intensifier according to claim 6, wherein said ring member is made of an Fe—Ni—Cr alloy.

9. An image intensifier according to claim 6, wherein said ring member is made of an Fe—Ni—Cu alloy.

10. An image intensifier according to claim 6, wherein the thickness of said window falls within a range of 0.5 to 2.0 mm.

11. An image intensifier according to claim 6, wherein the thickness of said ring member of Al or an Al-based alloy is greater than that of said window.

12. An image intensifier according to claim 11, wherein the thickness of said ring member is not less than 2 mm.

13. An image intensifier according to claim 11, wherein the inner diameter of said ring member is smaller than that of said curved portion of said window by not less than 2 mm at a boundary between said curved portion and said flange portion.

14. An image intensifier according to claim 1, wherein said flange portion of said window and said ring member are bonded by use of a pressure welding process.

15. An image intensifier according to claim 1, wherein said flange portion of said window and said ring member are bonded by use of an arc welding process.

16. An image intensifier according to claim 14, wherein a groove is formed around the circumference of said ring member.

17. An image intensifier according to claim 1, wherein an inner end portion of said ring member is urged against or in tight contact with said curved portion of said window.

18. An image intensifier according to claim 1, wherein an outer end portion of said ring member is located closer to said output screen than is the inner end portion thereof.

19. An X-ray image intensifier comprising:

a container having an interior lined with lead plates;

an evacuated envelope including a cylindrical body having an open end and a closed end, an X-ray window covering said open end, said X-ray window including:

a domed portion expanding outwardly from said evacuated envelope;

a flange portion formed around a peripheral edge of said window and having a flat bonding surface extending perpendicular to the central axis of said evacuated envelope; and a curved portion that forms a transitional area extending from said domed portion to said flange portion, and a ring member providing a hermetic seal disposed between said body and said flange portion of said window at the open end of said cylindrical body, said ring member having an inner end that has a smaller inner diameter than an outer diameter of said curved portion of said window to help prevent implosion of said X-ray window during manufacture of said X-ray image intensifier;

an input screen housed in said evacuated envelope for converting incident X-rays into photo-electrons; and an output screen housed in said evacuated envelope for converting the photo-electrons from said input screen into visible light and forming an image.

* * * * *